US006601268B2

(12) United States Patent
Seo

(10) Patent No.: US 6,601,268 B2
(45) Date of Patent: Aug. 5, 2003

(54) DOOR HINGE CUM DOOR CHECKER OF VEHICLES

(75) Inventor: Jeong-Min Seo, Ulsan-shi (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/991,204

(22) Filed: Nov. 20, 2001

(65) Prior Publication Data

US 2002/0062534 A1 May 30, 2002

(30) Foreign Application Priority Data

Nov. 24, 2000 (KR) ..... 2000-70383

(51) Int. Cl.[7] ..... E05D 11/10

(52) U.S. Cl. ..... 16/334; 16/82; 16/50; 16/374

(58) Field of Search ..... 16/334, 82, 50, 16/371, 374; 296/146.11, 146.12

(56) References Cited

U.S. PATENT DOCUMENTS 4,829,633 A * 5/1989 Kassner ..... 16/322
5,109,572 A * 5/1992 Park ..... 16/334
5,311,644 A * 5/1994 Laforgerie ..... 16/334
5,412,842 A * 5/1995 Riblett ..... 16/334
5,452,501 A * 9/1995 Kramer et al. ..... 29/11
5,918,347 A * 7/1999 Morawetz ..... 16/322
6,000,098 A * 12/1999 Kluting ..... 16/334
6,070,294 A * 6/2000 Perkins et al. ..... 16/252
6,073,308 A * 6/2000 Linnenbrink et al. ..... 16/334
6,481,056 B1 * 11/2002 Jesse ..... 16/334

FOREIGN PATENT DOCUMENTS

DE 19909500 A1 * 9/2000
EP 208085 A2 * 1/1987
EP 0254154 A2 * 1/1988
EP 0255879 A2 * 2/1988
EP 1132561 A1 * 9/2001
EP 1138859 A1 * 10/2001

* cited by examiner

*Primary Examiner*—Chuck Y. Mah
(74) *Attorney, Agent, or Firm*—Christie, Parker & Hale, LLP

(57) ABSTRACT

A door hinge cum door checker of vehicles, wherein a stopper and a hinge pin are integrally formed at a fixation arm mounted to a body while a rotary arm mounted to the door is disposed with a rotary arm mounted to the door is disposed with a roller insertedly accommodated into first/second hole and of the hinge pin by resilient member and a hitching jaw where the stopper is hitched, such that the present invention performs the function of door hinge with the rotary arm rotating about the hinge pin and performs the function of door checker in as much as the roller is received by the first groove or the second grove in response to opened degree of the door while the stopper is hitched by the hitching jaw when the door is fully opened, thereby eliminating the necessity of separate door checker to achieve an effect of reduced number of assembling processes and decreased manufacturing cost.

8 Claims, 4 Drawing Sheets

FIG.6a
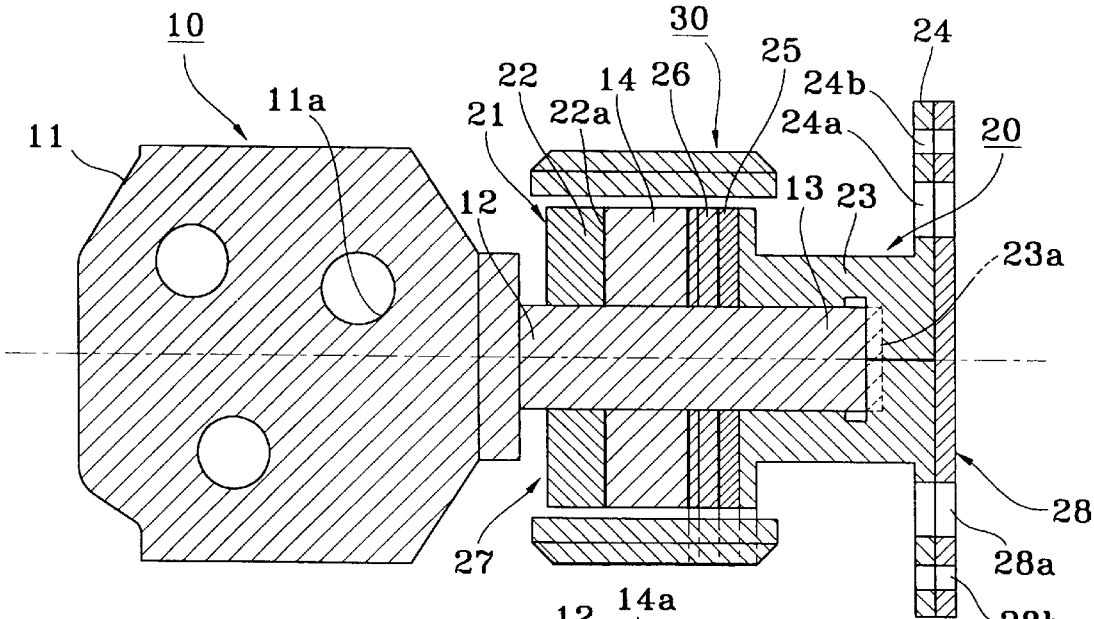
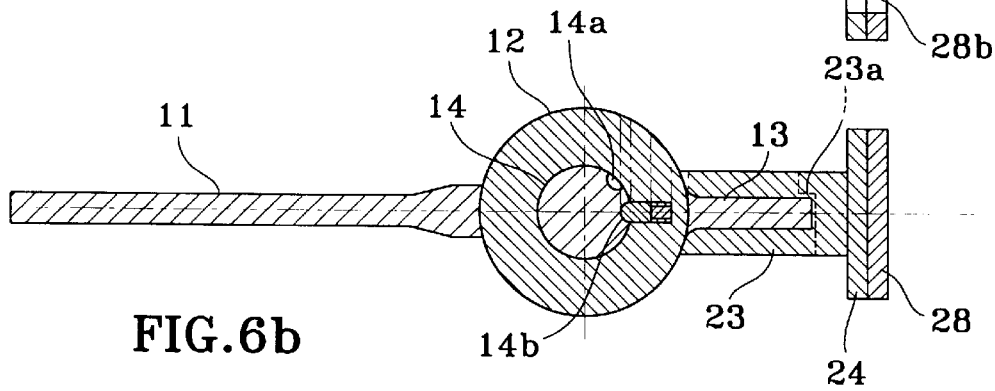
FIG.6b

DOOR HINGE CUM DOOR CHECKER OF VEHICLES

CROSS-REFERENCE TO RELATED APPLICATION

This application claims priority of Korea patent Application No. 2000-70383, filed on Nov. 24, 2000.

BACKGROUND OF THE INVENTION

1. Field of the Invention

The present invention relates to a door hinge of vehicles, and more particularly to a door hinge cum door checker of vehicles adapted to serve as door checker eliminating the necessity of installing a separate door checker.

2. Description of the Prior Art

In general, a door 110 of a vehicle is attached to a body 120 at an upper part and at a lower part via door hinges 130 for opening and closing, and is installed at a midsection with a door checker 140 to enable to keep the door 110 to stay at an opened state at a predetermined position, as illustrated in FIG. 1.

As illustrated in FIG. 2, a body member 131 and a door member 132 are coupled via a hinge pin 133 where, the body member 131 and flange 132*a* of the door member 132 are formed with coupling holes 131*a* and 132*b* through which the body 120 and the door 110 are installed via each bolt.

The door checker 140 includes a hinge bracket 141 mounted at the body 120, a checker bar 142 hinged to the hinge bracket 141 and a checker body 143 mounted at the door 110 for accommodating the other part of the checker bar 142 lest it should be loosened, where the checker bar 142 is formed with a groove 142*b*, as illustrated in FIG. 3.

When the door 110 is rotated about the hinge pin 133, the checker body 143 is moved to the left and to the right on the checker bar 142, where a roller (not shown) in the checker body 143 is moved when the door 110 is opened from a position near an approximate area 142*a* of the hinge bracket 141 while the door is closed, thereby positioning itself at the groove 142*b*.

The roller is pushed toward the checker bar 142 by support means (by way of example, a spring) mounted inside the checker body 143, such that the door 110 where external force is not applied maintains the opened state at a position thereof when accommodated at the groove 142*b*.

The door hinge 130 and the door checker 140, each mounted in between the body 120 and the door 110, are rotated, closed and opened in a state where the door 110 is installed at the body 120, and serve to perform a function of maintaining the door 110 to be at the opened state at a predetermined position.

However, there is a problem in that, even though the door hinge 130 and the door checker 140 are all mounted between the body 120 and the door 110, and are actuated by the same cause of opening/closing operation by the door 110, the number of assembling process is increased due to their being separated items, and assembling cost thereof is also raised.

SUMMARY OF THE INVNETION

The present invention is disclosed to solve the aforementioned problems and it is an object of the present invention to provide a door hinge cum door checker of vehicles adapted to enable to perform two functions of door checker and door hinge by one part thereby reducing the number of parts and assembling processes and decreasing costs thereof.

In accordance with the object of the present invention, there is provided a door hinge cum door checker of vehicles, wherein the door hinge cum door checker comprises:

a fixation arm having a round body formed at a mounting plate formed with a mounting hole for mounting to a body while the round body is formed at a tip end thereof with a stopper, a hinge pin formed through the round body and the hinge pin formed with a first groove and a second groove;

a rotary arm having an upper arm and a lower arm, each inserted into the hinge pin and each having a steel roller received by the first and second groove of the hinge pin in response to rotating state of a door, and a coupling plate for coupling the upper arm and the lower arm, where mounting holes are formed at the upper/lower arms and at the coupling plate for mounting to the door, while the upper/lower arms are formed at a connecting body thereof with a hitching jaw at which the stopper of the fixation arm is hitched; and a cap for respectively covering the upper arm and the lower arm of the rotary arm.

BRIEF DESCRIPTION OF THE DRAWINGS

For fuller understanding of the nature and objects of the invention, reference should be made to the following detailed description taken in conjunction with the accompanying drawings in which:

FIG. 4, including

FIG. 5, including FIG. 6, including FIGS. 6*a* and 6*b*, show schematic front and plan cross-sectional views illustrating how the door checker cum door hinge is assembled according to the present invention.

DETAILED DESCRIPTION OF THE INVENTION

Now, preferred embodiment of the present invention will be described in detail with reference to the accompanying drawings.

The present invention, as mentioned in the foregoing, includes a fixation arm mounted to a body, a rotary arm rotatively connected to the fixation arm and mounted to a door, and a cap for covering a connected part between the rotary arm and the fixation arm.

Figure 1:
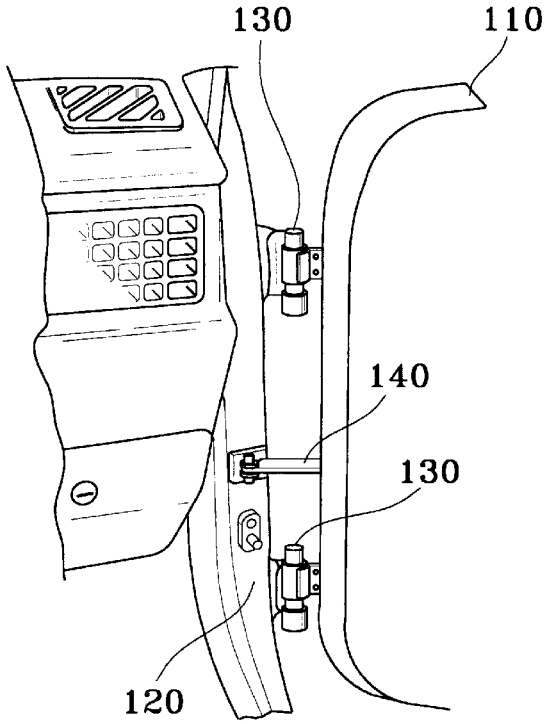
FIG.1 (prior art)
FIG. 1 is a schematic drawing for illustrating how a door of a vehicle is mounted.
Figure 2:
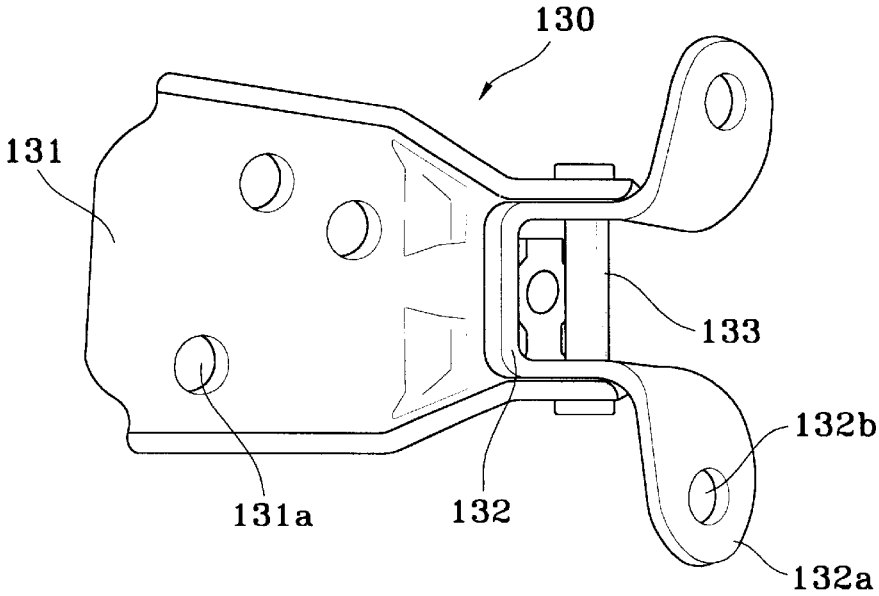
FIG.2 (prior art)
FIG. 2 is a perspective view of a door hinge.
Figure 3:
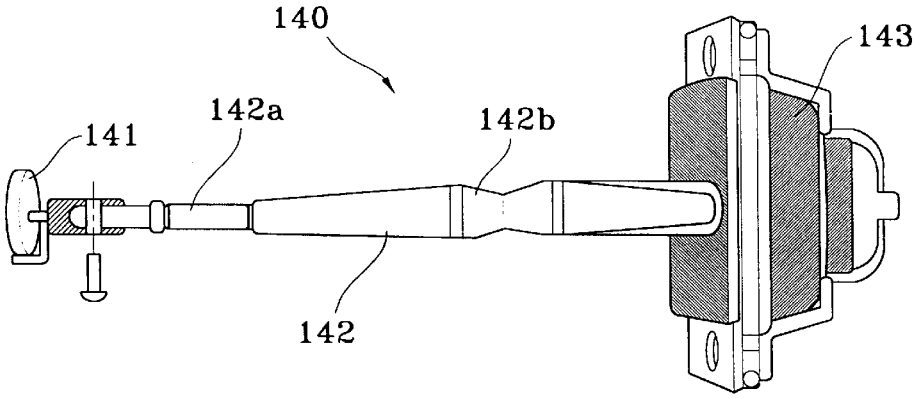
FIG.3 (prior art)
FIG. 3 is a perspective view of a door checker.
Figure 4A:
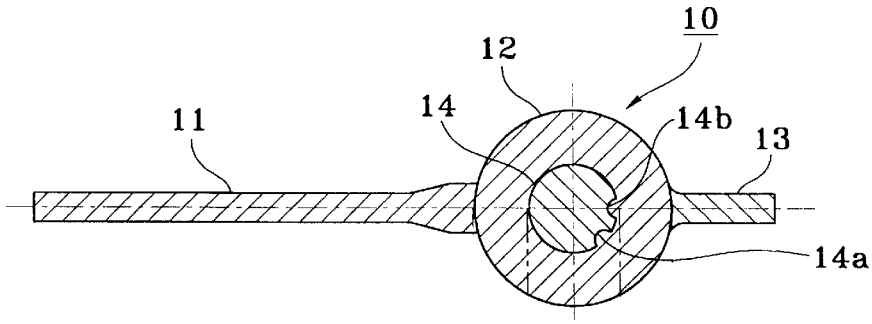
FIGS. 4*a* and 4*b*, shows plan and front cross-sectional views of a fixation arm of a door checker cum door hinge according to the present invention.
Figure 4B:
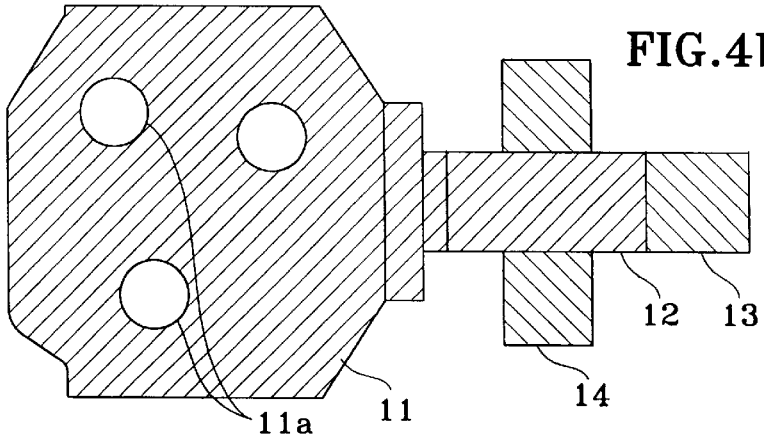

In other words, as illustrated in FIG. 4, the fixation arm 10 is formed with three mounting holes 11*a* on a flat-plated mounting plate 11 while the mounting plate 11 is integrally formed with a round body 12.

The round body 12 is defined at upper and lower surfaces thereof with a hinge pin 14 while the hinge pin 14 is formed with a second groove 14*b* at an opposite side of a same line with the mounting plate 11 and a first groove 14*a* is formed at a predetermined interval from the second groove 14*b*. Meanwhile the round body 12 is formed with a stopper 13 of flattened square protruding piece on a same line with the mounting plate 11.

Figures 5A, 5B, 5C:
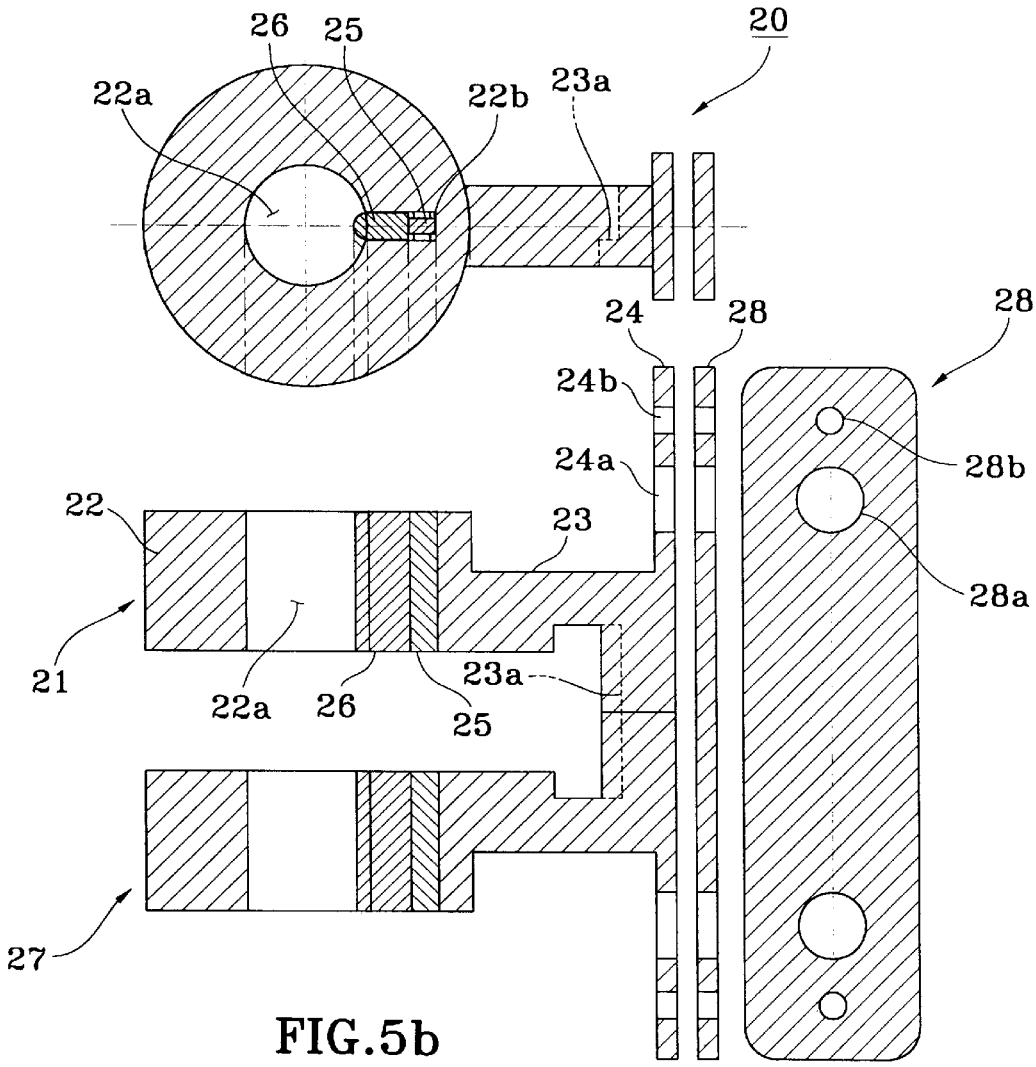
FIGS. 5*a*, 5*b*, and 5*c*, shows plan and front cross-sectional views of a rotary arm and a coupling plate to which the rotary arm is connected of the door checker cum door hinge according to the present invention and a side cross-sectional view of the coupling plate.

Furthermore, as illustrated in FIG. 5, the rotary arm 20 includes an upper arm 21, a lower arm 27 and a coupling plate 28 for coupling the upper and lower arm 21 and 27, where the upper arm 21 and the lower arm 27 are the same in shapes and constructions therebetween, such that only the upper arm 21 while be described.

The upper arm 21 includes a round body 22 formed with an insertion hole 22*a* through which a hinge pin 14 is inserted, a connection body 23 extended from one side of the round body 22 and a mounting plate 24 perpendicularly extended from the connection body 23.

The round body 22 is formed with a mounting groove 22*b* toward the connection body 23 away from the wall side thereof and a roller supported by resilient member 25 such as spring, rubber of the like is installed in the mounting groove 22*b*. The connection body 23 is defined by a hitching jaw 23*a* toward the rear side thereof while the mounting plate 24 is disposed with an mounting hole 24*b* for a large bolt and a coupling hole 24 for a small bolt.

Meanwhile, the coupling plate 28 is an approximate square plate combining the shapes and areas of the mounting plate 24 at the upper arm 21 and the mounting plate at the lower arm 27, where same size of mounting hole 28*a* and a coupling hole 28*b* are formed in opposite corresponding positions from the mounting hole and the coupling hole formed at the coupling plate.

Now, as illustrated in FIG. 6, round bodies at the upper arm and the lower arm are respectively installed at upper and lower sides of the hinge pin 14 at the fixation arm 10, by which mounting plates at the upper and lower arm, each adhered at upper and lower side thereof, are abutted by the coupling plate 28 and the fixation arm 10 and the rotary arm 20 are assembled by using bolts and nuts through coupling holes at the mounting plate and the coupling plate.

The assembly is complete when a cap 30 is installed for preventing raindrops, dust or the like from penetrating the upper side of the upper arm 21 and the lower side of the lower arm 27, which is a joint area between the fixation arm 10 and the rotary arm 20.

In the assembled state thus described, when the mounting plate 11 at the fixation arm 10 is secured to the body, and the mounting plate of the rotary arm 20 and coupling plate 28 are mounted to the door, a whole installation of the door hinge cum door checker of vehicles according to the present invention is completed.

Now, operations of the present invention are described. In the door hinge cum door checker of vehicles thus constructed according to the present invention, the round hinge pin 14 is inserted through the round insertion hole 22*a* at the upper/lower arm to enable the rotary arm 20 to be rotatively moved on the fixation arm 10, such that the function of door hinge capable of opening and closing the door can be normally performed.

Meanwhile, FIG. 6 illustrates a state where the door is fully opened, where the roller 26 of the rotary arm 20 in the fully opened state of the door is pushed by the resilient member 25 to be received by the second groove 14*b* formed at the hinge pin 14 of the fixation arm 10. At this time, the stopper 13 at the fixation arm 10 is hitched by the hitching jaw 23*a* at the rotary arm 20. As a result thereof, the door is no longer opened.

Meanwhile, when the door is to be closed, the rotary arm 20 is rotated counterclockwise, such that when the roller 26 is accommodated in the first groove 14*a* of the hinge pin 14 while the rotary arm 20 is rotated counterclockwise, the door is no longer closed or opened at this position, enabling to be opened at a predetermined state.

Successively, when the door is rotated to a direction described by a user, the roller 26 is pressed down by the surface of the hinge pin 14 to compress the resilient member 25 and to be inserted into the mounting groove 22*b*, where the door maintains the fully closed state because striker is held by a door latch.

Meanwhile, when the door is opened, operation in the reversed order occurs. In other words, when the roller 26 is hitched by the first groove 14*a*, the door is made to maintain an opened state at a predetermined level, and if the door is further opened, the roller 26 is received by the second groove 14*b* and the stopper 13 at the fixation arm 10 is hitched by the hitching jaw 23*a* at the rotary arm 20 such that the door is no longer opened and keeps maintaining the opened state as it is. In other words, the door hinge performs the function of door checker is response to inter-operation between the first/second groove 14*a* and 14*b* at the fixation arm 10 and the roller 26 formed at the rotary arm 20.

As apparent from the foregoing, there is an advantage in the door hinge cum door checker of vehicles according to the present invention thus described in that the door hinge can simultaneously perform the function of door checker, and only two door hinges are needed to be installed at upper and lower parts of the door, thereby eliminating the necessity of separate erstwhile installation of door checker, reducing the number of parts and manufacturing processes for improvement of work efficiency.

What is claimed is:

1. A door hinge cum door checker for attachment to a vehicle comprising:

a fixation arm for mounting to a body of the vehicle comprising:

a mounting plate having a mounting hole, a round body attached to the mounting plate and having integrally formed thereabove and thereunder a hinge pin that includes a first groove and a second groove, and a flat square stopper protruding from the round body on a portion of the round body that is opposite to the portion of the round body that is attached to the mounting plate; and a rotary arm for mounting to a door of the vehicle comprising:

an opening that receives the hinge pin, such that the hinge pin rotatably connects the rotary arm to the fixation arm, a roller that removably engages the first and second grooves when the rotary arm is rotated with respect to the fixation arm, and a hitching jaw that receives the stopper, wherein when the roller is engaged in the first groove of the hinge pin the door is disposed in a half-opened position and wherein when the roller is engaged in the second groove of the hinge pin the door is disposed in a fully-opened position.

2. A door hinge cum door checker for attachment to a vehicle comprising:

a fixation arm for mounting to a body of the vehicle, wherein the fixation arm comprises a stopper protruding therefrom and an integrally formed upper and lower hinge pin, wherein the upper and lower hinge pins each have a first groove and a second groove; and a rotary arm for mounting to a door of the vehicle comprising:

an upper arm comprising a round body having an insertion hole that receives the upper hinge pin, such that the upper hinge pin rotatably connects the upper arm to the fixation arm, a mounting groove in the round body adjacent to the insertion opening that receives an upper roller that is resiliently supported by a resilient member, and a connection body attached to the round body, having a hitching jaw that receives the stopper of fixation arm;

a lower arm having a same shape and construction as those of the upper arm and receiving the lower hinge pin from an underside of the fixation arm; and a coupling plate that is attached to a mounting plate of the upper arm and to a mounting plate of the lower arm to connect the upper and lower arms when the upper arm and the lower arm are respectively attached to the upper and lower hinge pins.

3. The door hinge cum door checker of claim 2 wherein the upper and lower mounting plates and the coupling plate each comprise coupling holes of a small diameter for coupling the upper and lower arms to the coupling plate and holes of a large diameter for coupling the upper and lower arms and the coupling plate to the door.

4. The door hinge cum door checker of claim 2 wherein a cap is connected to the round body of the upper arm.

5. A door hinge cum door checker for attachment to a vehicle comprising:

a fixation arm for mounting to a body of the vehicle;

a hinge pin attached to the fixation arm and having a first groove and a second groove; and a rotary arm for mounting to a door of the vehicle comprising:

an upper arm having an insertion opening that receives the hinge pin, such that the hinge pin rotatably connects the upper arm to the fixation arm;

a lower arm having an insertion opening that receives the hinge pin, such that the hinge pin rotatably connects the lower arm to the fixation arm;

an upper roller resiliently connected to the upper arm, and a lower roller resiliently connected to the lower arm, wherein each roller removably engages the first groove when the rotary arm is rotated to a first position with respect to the fixation arm, and wherein each roller removably engages the second groove when the rotary arm is rotated to a second position with respect to the fixation arm.

6. The door hinge cum door checker of claim 5 wherein when the rollers are engaged in the first groove of the hinge pin the door is disposed in a partially-opened position and wherein when the rollers are engaged in the second groove of the hinge pin the door is disposed in a fully-opened position.

7. The door hinge cum door checker of claim 5, further comprising a stopper attached to the fixation arm and wherein the upper and lower arms together form a hitching jaw that receives the stopper.

8. The door hinge cum door checker of claim 5, further comprising a coupling plate that is attached to the upper arm and to the lower arm to connect the upper and lower arms.

* * * * *